US006684714B2

(12) United States Patent
Mills et al.

(10) Patent No.: US 6,684,714 B2
(45) Date of Patent: Feb. 3, 2004

(54) METHOD AND APPARATUS FOR TESTING FLUID FLOW THROUGH TRANSMISSION COOLING SYSTEMS

(75) Inventors: Richard Mills, LaPorte, IN (US); Walter Murray, Pioneer, OH (US); Daniel J. Popoff, Canton, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/143,811

(22) Filed: May 14, 2002

(65) Prior Publication Data

US 2003/0213309 A1 Nov. 20, 2003

(51) Int. Cl.[7] ..... G01F 1/00; B65B 1/04; B65B 3/04; B67C 3/02

(52) U.S. Cl. ..... 73/861; 141/98

(58) Field of Search ..... 141/98, 65, 4; 73/861

(56) References Cited

U.S. PATENT DOCUMENTS

| | | | | | |
|---|---|---|---|---|---|
| 5,370,160 | A | * | 12/1994 | Parker | 141/98 |
| 5,626,170 | A | * | 5/1997 | Parker | 141/98 |
| 6,035,903 | A | * | 3/2000 | Few et al. | 141/98 |
| 6,213,175 | B1 | * | 4/2001 | Rome et al. | 141/98 |

* cited by examiner

*Primary Examiner*—Edward Lefkowitz
*Assistant Examiner*—Takisha S Miller
(74) *Attorney, Agent, or Firm*—Baker & Hostetler LLP

(57) ABSTRACT

Method and apparatus provided to accurately test fluid flow through cooling systems including pressurizing a fluid to create a fluid flow into the cooling system, measuring a fluid flow rate, and determining when the fluid flow rate is acceptable.

19 Claims, 3 Drawing Sheets

METHOD AND APPARATUS FOR TESTING FLUID FLOW THROUGH TRANSMISSION COOLING SYSTEMS

FIELD OF THE INVENTION

The present invention relates generally to the field of measuring fluid flow rates. More particularly, the present invention relates to a method for testing fluid flow through transmission cooling systems and a transmission cooling system flow tester device.

BACKGROUND OF THE INVENTION

Many consumer and industrial vehicles use automatic transmissions filled with automatic transmission fluid (ATF) as the working fluid and to aid in cooling the transmission. In typical configurations, automatic transmissions are equipped with a cooling system, such as an oil cooler, that may be located, for instance, inside an automobile radiator. The automatic transmission fluid is cycled through the oil cooler to regulate its temperature and then back into the transmission in order to keep the transmission cool.

The importance of maintaining fresh and clean transmission fluid is essential in keeping the transmission cool. At regular intervals, the automatic transmission fluid should be removed from the transmission and replaced with fresh fluid as the fluid properties degrade with time and in use. Lack of proper service can cause engine problems due to the fact that old ATF may no longer protect against rust or acids that can lead to a breakdown of the metal and aluminum parts in the vehicle's oil cooler or transmission. Furthermore, entrained contaminants and debris, not fully removed by the transmission's filter assembly, can clog the oil cooler. The result of which is that proper ATF flow through the oil cooler and to the transmission is prevented. Improper ATF flow can cause the transmission to overheat and produce serious, if not, permanent damage.

Transmission fluid exchanges are often performed in order to replace old transmission fluid with fresh and clean transmission fluid. During the exchange, a transmission may be left running in order to allow the transmission pump to cycle in the new transmission fluid while cycling out the old fluid. However, if there is any blockage, e.g., in the oil cooler, the new transmission fluid will not flow at the proper rate into the transmission, in which case, overheating may occur.

In instances where a transmission is replaced, it is important to test the ATF flow through a reused oil cooler which is reconnected to the new transmission. This is to ensure that no debris from the replaced transmission was transferred into the reconnected oil cooler during its original use. Such debris can prohibit fluid flow to the newly installed transmission once the entire system is reconnected. If fluid flow is prohibited by any debris within the oil cooler, the efficiency of providing thermal dissipation to the circulating fluid is greatly inhibited. Thus, a newly installed transmission will not be properly cooled due to a combination of the lack of fluid it receives from the blocked oil cooler or the improperly maintained temperature regulation of the fluid being received from the cooler. The result, of which, ruins the newly installed transmission due to overheating.

A need still exists, therefore, for an evaluation of fluid flow through the cooling system which identifies whether the fluid is continuously flowing properly. A need further exists for checking fluid flow through the cooling system in order to ensure that additional procedures can be perform on the cooling system in a safe manner and without producing subsequent damage to a connected transmission system due to an unknown blockage.

SUMMARY OF THE INVENTION

The foregoing need has been met by the present invention, whereby in one aspect of the invention, a method is provided to test fluid flow through a cooling system. The method includes pressurizing transmission fluid to create fluid flow. A fluid flow rate measurement is ascertained and a determination is made of whether the fluid is flowing at a proper rate.

In another aspect of the invention, a cooling system fluid flow testing device is provided including a means for pressurizing fluid to create a fluid flow. The invention further includes a means for measuring a fluid flow rate and a means for determining whether the fluid is flowing properly.

In another aspect of the invention, a cooling system fluid flow testing apparatus is provided including a fluid supply tank connected to a controlled air pressure system. The supply tank provides fluid to flow through the cooling system as the fluid is pressurized to generate a fluid flow. A flow transducer is utilized to measure the rate of fluid flow and sends the fluid rate measurements to a processor. The processor is further operable to send the fluid rate measurements to a light-emitting diode (LED) display. Additionally, fluid emanating from the cooling system is directed through the apparatus' fluid return line into a connected waste receptacle tank.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
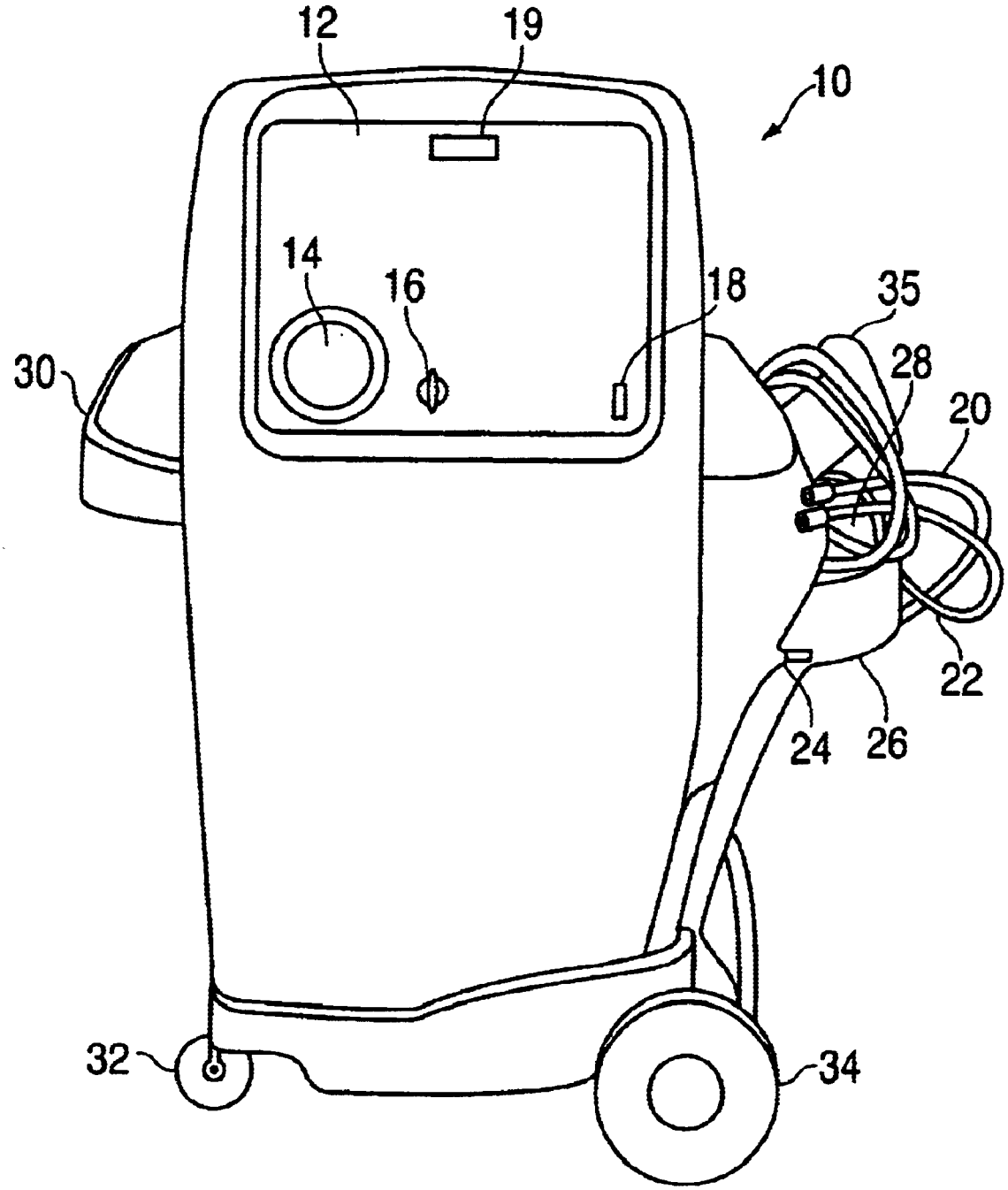
FIG. 1 is a perspective view of the front of a flushing cooling system in accordance with a preferred embodiment of the present invention.

The present invention provides an apparatus, as depicted in FIG. 1, for testing flow to a cooling system and/or a transmission, flushing the cooling system or exchanging transmission fluid. The device 10 includes a stamp steel skeleton with a plastic exterior shell. The interface 12 allows an operator to set the device for performing a variety of functions by selecting an operating mode. The selected mode allows the device to perform one of either a fluid flow testing operation, a cooling system flushing operation, or a fluid exchange operation.

In the flow testing mode, the apparatus acts as a flow diagnostic machine by determining whether fluid flowing from an independent source is properly flowing through a cooling system. In the flushing mode, the apparatus provides turbulence to the fluid flow and performs a flushing operation. In the exchange mode, the apparatus compares flow entering and leaving a transmission and adjusts the rate of flow accordingly as it simultaneously exchanges old ATF with clean ATF.

In operation, an operator fills the device with fluid through the fill port 14. The flow testing operating mode is manually selected by setting the knob selector 16, and the device is powered on by switch 18. An LED display 19 exhibits information such as fluid flow rate, transmission fluid temperature, low battery indicator for an insufficiently charged 12 volt supply source (not shown), incorrect hook-up warning, and fluid level in the supply tank.

From the displayed information, an operator is able to determine the condition of the cooling system. Moreover, this information better equips the operator to judge whether to perform additional procedures on the cooling system, for example, a flushing operation in order to ensure proper flow rates. Additionally, the aforementioned information aids in knowing whether the cooling system condition will adequately support additional procedures such as a fluid exchange.

As further shown in FIG. 1, external quick disconnect fluid hoses 20, 22 are available for connecting to a cooler system or in combination with a transmission system depending upon the selected operating mode. In a preferred embodiment of the invention, typically, one hose 20 serves as a clean ATF supply line connecting to a cooling system, e.g., an oil cooler. The other hose 22 serves as a return line back into the device to direct discharged ATF into a waste receptacle 26. An external compressed air supply source (not shown) is connected to an air intake valve 24. Trays 28, 30 provide convenient storage containers for tools and equipment. The entire device 10 is portable and maneuverable by attached wheels 32, 34 and handle 35.

Figure 2:
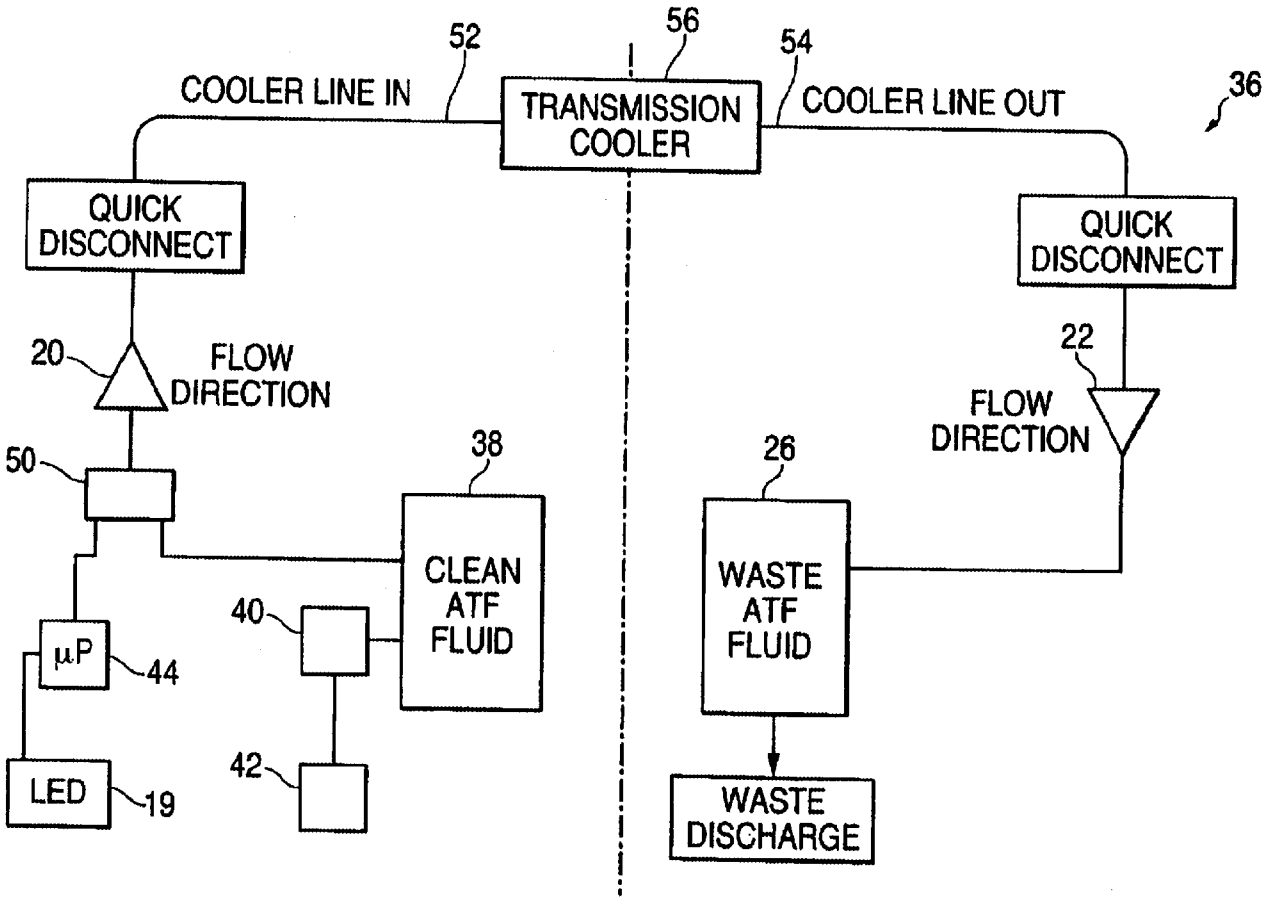
FIG. 2 is a block diagram of the connection of the feed hoses during setup of the flushing cooling system of FIG. 1.

Referring now to FIG. 2, an illustrative set-up connection is dipected for performing the method of a preferred emboidment of the -invention. As shown, a block diagram 36 of the device for initially testing flow through the transmission cooler 56 is depicted. Compressed air 40 is provided by an external source 42 to supply through the air intake fitting 24, FIG. 1, into a steel supply tank 38. The supply tank 38 also receives ATF from the fill port 14. The supply line hose 20 is connected to the supply tank 38 and delivers ATF to the cooling system 56. A flow transducer 50 is attached to either the supply line hose 20 or the return line hose 22 as shown in FIGS. 2 and 2, respectively.

During setup, the source of clean ATF is connected to the supply line hose 20 of the device, and the supply line hose is hooked into the line in side 52 of the cooling system 56. The line out side 54 of the cooling system 56 is initially hooked into return line hose 22 of the device 10. Connected in this manner, used ATF fluid in the cooling system 56 is allowed to flow into the waste receptacle 26 during the device's operation.

In operation, compressed air is supplied to the device which pressurizes the ATF in the supply tank to generate a fluid flow. As will now be discussed, the device performs a flow test in order to determine how well fluid is flowing through the cooling system. In this process, the flow transducer 50 monitors the fluid flow rate. During the flow test, processor 44 receives information corresponding to fluid flow rate measurements taken by the flow transducer 50. The processor also relays the fluid flow rate measurement values to the LED display 19 for an operator to read. Based upon the displayed measurements, an operator may choose to perform additional processes.

For instance, a low fluid flow rate may indicate to an operator that there is a blockage within the cooling system, since trapped debris is one cause of diminished fluid flow rates. Such debris will ultimately cause fluid flow backup within the flow control system, in-effect, generating the reduced fluid flow rate. Left un-removed, the cooling system debris will cause a reassembled transmission system to overheat as a result of fluid flow back-up and, hence, improper cooling of the transmission system. In this instance, a flushing operation may be performed in order to clear any blockages and to restore the fluid flow rate to an acceptable level.

Alternatively, the displayed measurements could indicate to an operator that the fluid flow rate is up to standard. In this case, the operator can be confident in performing additional procedures on the cooling system such as a fluid exchange since the fluid flow test would adequately confirm proper flow rates through the oil cooler. Thus, the need to perform a fluid flow check on a cooling system is never performed in vain to the informed operator.

Figure 3:
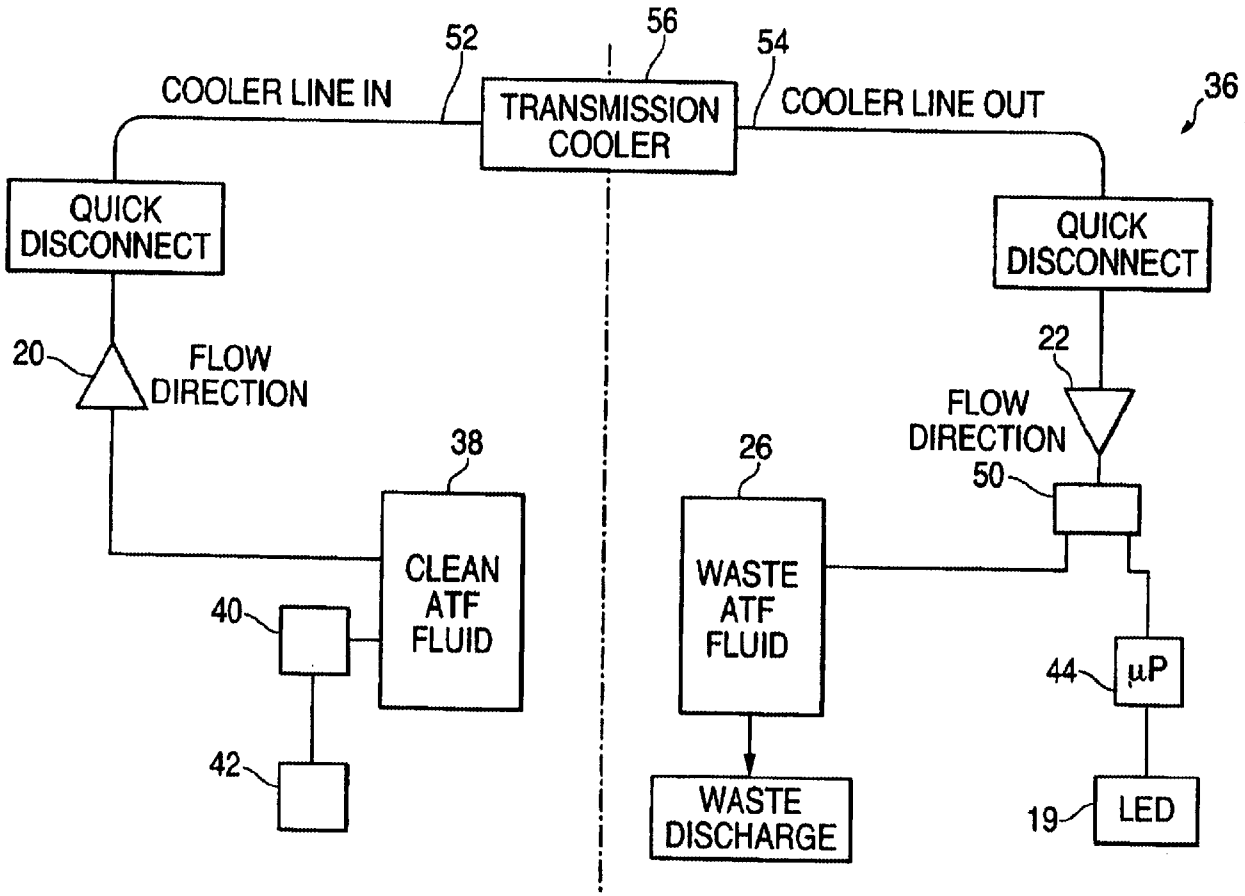
FIG. 3 is a block diagram of the connection of the feed hoses during an alternative setup of the flushing cooling system of FIG. 1.

Hence, the fluid flow rate data from the set-up procedure shown in FIGS. 2 and 3 provide accurate information to an operator in order to make an educated assessment of the performance integrity of the cooling system. Based upon this information, the operator can not only make a knowledgeable decision as to whether to employ subsequent operations, but also decide what kind of operations to perform upon the cooling system.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed:

1. A method of testing fluid flow in a cooling system comprising:

pressurizing a fluid to create a fluid flow into the cooling system;

measuring a fluid flow rate at a point prior to said fluid flow entering into said cooling system;

indicating the fluid flow rate on a display; and determining whether said fluid flow rate is acceptable.

2. The method of claim 1 wherein the pressuring and measuring processes are enabled by a cooling system flow testing apparatus.

3. The method of claim 2 wherein the fluid is transmission fluid.

4. The method of claim 1 further comprising:

measuring the fluid flow rate with a flow transducer.

5. The method of claim 1 further comprising:

measuring the fluid flow rate at a point after said fluid flow leaves said cooling system.

6. The method of claim 5 further comprising:

measuring the fluid flow rate with a flow transducer.

7. The method of claim 1 further comprising:

pressurizing the fluid flow rate with an external air supply source.

8. The method of claim 1 further comprising:

delivering the pressurized fluid to said cooling system through a fluid supply; and delivering the pressurized fluid from said cooling system through a fluid return line.

9. A cooling system fluid flow testing device comprising:

means for pressurizing a fluid to create a fluid flow into the cooling system;

means for measuring a fluid flow rate at a point prior to said fluid flow entering into said cooling system;

means for indicating the fluid flow rate; and means for determining whether said fluid flow rate it acceptable.

10. The device of claim 9 wherein the means for pressuring and means for measuring are enabled by a cooling system flow testing apparatus.

11. The device of claim 9 wherein the fluid is transmission fluid.

12. The device of claim 9 further comprising:

a means for measuring the fluid flow rate at a point after said fluid flow leaves said cooling system.

13. The device of claim 9 further comprising:

a means for delivering the pressurized fluid to said cooling system; and a means for delivering the pressurized fluid from said cooling system.

14. A cooling system fluid flow testing apparatus comprising:

a fluid supply line capable of supplying fluid from a fluid supply tank to a cooling system;

a fluid return line capable of directing fluid from the cooling system to a waste receptacle;

a flow transducer attached to the supply line, said transducer determines at least one fluid flow rate measurement;

a processor connected to said flow transducer, said processor receives said at least one fluid flow rate measurement from said flow transducer and indicated a fluid flow rate; and a display connected to said processor, said processor indicates the fluid flow rate on said display.

15. The apparatus of claim 14 wherein the cooling system is a transmission oil cooler.

16. The apparatus of claim 14 further comprising:

trays.

17. The apparatus of claim 16 further comprising:

attached wheels, said wheels allow the apparatus to be portable and maneuverable.

18. The apparatus of claim 16 further comprising:

at least one attached handle.

19. The apparatus of claim 14 wherein the display indicates whether the fluid flow rate is acceptable.

* * * * *